United States Patent [19]

Hopper

[11] Patent Number: 5,040,606

[45] Date of Patent: Aug. 20, 1991

[54] ANNULUS SAFETY VALVE

[75] Inventor: Hans P. Hopper, Aberdeen, Scotland

[73] Assignee: The British Petroleum Company p.l.c., London, United Kingdom

[21] Appl. No.: 575,249

[22] Filed: Aug. 30, 1990

[30] Foreign Application Priority Data

Aug. 31, 1989 [GB] United Kingdom ..... 8919704
Jan. 20, 1990 [GB] United Kingdom ..... 9001366

[51] Int. Cl.[5] ..... E21B 34/10
[52] U.S. Cl. ..... 166/332; 166/321
[58] Field of Search ..... 166/319–321, 166/332–334, 373–375

[56] References Cited

U.S. PATENT DOCUMENTS 4,449,583 5/1984 Lawson ..... 166/321 X
4,573,535 3/1986 Manke ..... 166/332 X
4,848,457 7/1989 Lilley ..... 166/332 X

*Primary Examiner*—Thuy M. Bui
*Attorney, Agent, or Firm*—C. S. Lynch; D. J. Untener; L. W. Evans

[57] ABSTRACT

A fail safe annulus valve for fluids has a valve area across the annulus with inlet and exit ports and a slide valve in the area capable of sliding to open or close the ports. The slide valve is biased to its fail safe position by a spring, is susceptible to being opened by independent pressure apparatus, and is also susceptible to movement by differential annulus fluid pressure across the valve. Thus while it fails safe, it can always be moved by differential annulus pressure. The valve may be used for the annuli of oil or gas wells (e.g. annuli used for artificial lift) and may be mounted on a packer of the annulus. It may also be used for closing other types of annuli.

11 Claims, 5 Drawing Sheets

ANNULUS SAFETY VALVE

Figure 1:
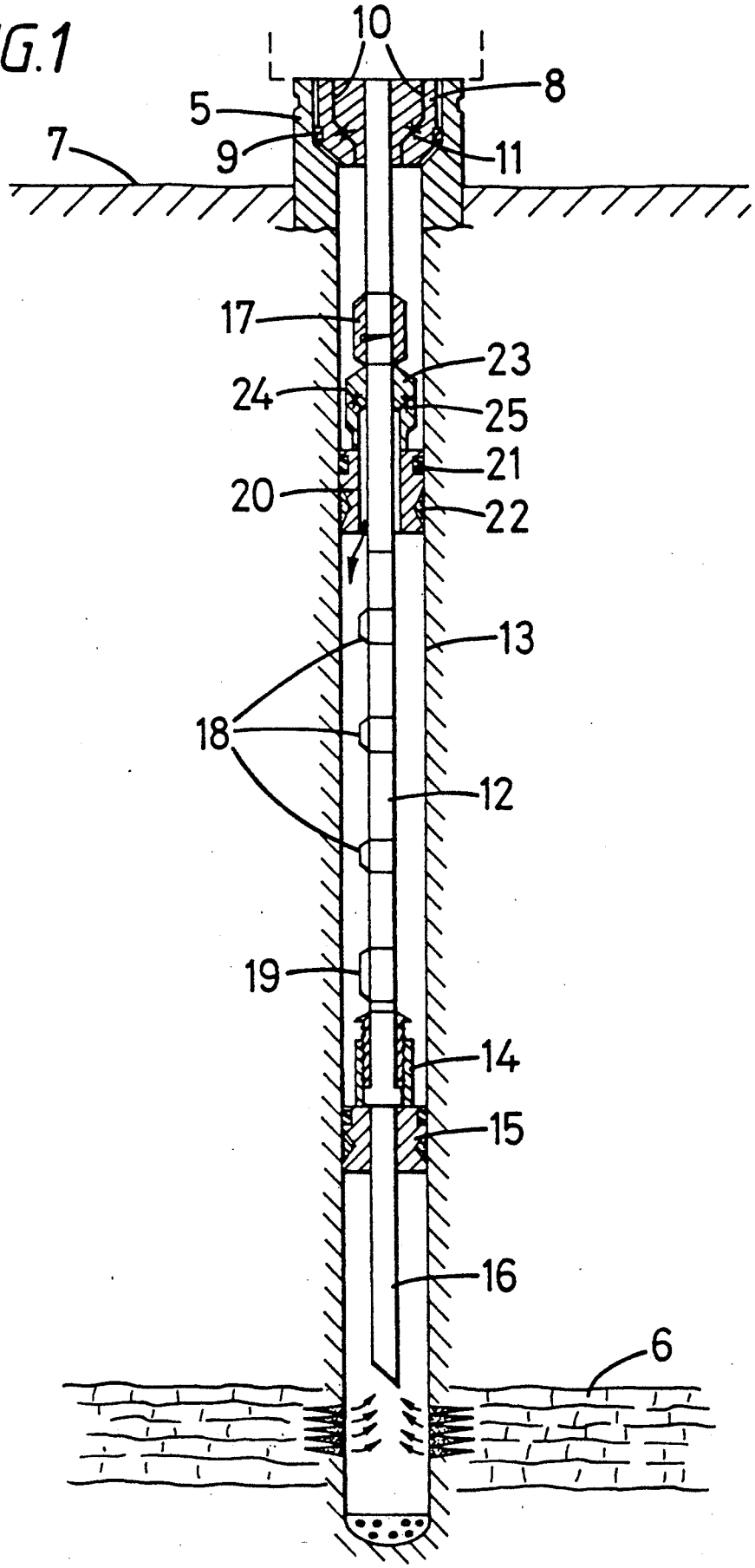

This invention relates to a safety valve for an annulus which will fail safe closed or open. It is particularly suitable for use as a down hole safety valve for the annulus of a well used for the production of oil or gas.

Wells used for oil and/or gas production normally have a central bore and a surrounding concentric annulus. At the well-head tubing hanger the fluid paths from the bore and annulus may retain the concentric configuration or be converted to a dual parallel bore configuration.

The relative merits of the two types of well head configuration are discussed in detail in our earlier UK Patent Application No. 2214543A. Briefly, the advantages of a concentric bore configuration (e.g. larger flow areas and simplicity) may be offset by the difficulty of isolating the annulus, i.e. of providing a suitably reliable valve which will isolate the annulus and fail safe in an emergency.

The aforementioned UK Patent Application No. 2214543A is concerned with an annulus valve suitable for a concentric bore well head tubing hanger which has a positive open/closed system but has a fail-as-is logic. Because it is not designed to fail safe closed (or open) it has a secondary back up system which will close (or open) it in the event of a failure of the primary operating system.

There are, however, situations where it would be desirable to have an annulus safety valve which automatically fails safe closed (or open). Such a safety valve would shut off pressure if a failure or malfunction occurred in the well. However, such a valve would still need to have the capability of allowing fluid circulation through the valve irrespective of the integrity of the control system. Such a capability would allow positive intervention to make the system safe.

A prime requirement for such a valve in oil and/or gas wells is as an annulus downhole safety valve where the annulus is used for artificial lift injection. However, such a valve could be of general use as a down hole annulus safety valve, or as an annulus valve for any concentric bore. Thus it could be useful as a fail safe valve for

- a concentric bore tubing hanger,
- other concentric bore flow paths (e.g. pipelines and risers),
- concentric bore pipeline connectors,
- annnulus flow paths around electrical conduits, and
- formation zone access between completion packers.

According to the present invention a fail safe annulus valve for fluids suitable for use, inter alia, as a down hole valve of an oil and/or gas well comprises:

(a) an inner and an outer sleeve across the annulus enclosing a valve area, (b) an inlet port into the area in one sleeve and an outlet port in the other, (c) a slide valve in the area capable of sliding to open or close the ports but biased to remain in a fail safe position if no pressure is applied to it, (d) means for applying positive pressure to one end of the valve to move the valve from its fail safe position, said means being independent of the annulus fluid pressures on either side of the valve, and (e) means to move the valve from its fail safe position if there is a predetermined differential annulus fluid pressure across the valve.

Normally the fail safe position will be closed but the valve could be adapted to fail safe open. The bias to maintain it in the fail safe position may be a spring of predetermined strength.

The slide valve itself may have a passage through it capable of being aligned with the inlet and exit ports to allow fluid flow through the valve. The passage and the ports may be angled (e.g. at 45°) with respect to flow along the annulus to avoid too drastic a change of direction of fluid flow through the valve.

The valve area enclosed by the inner and outer sleeves may itself be annular and the slide valve may be a cylinder sliding within the annulus. If so, there may be a number of inlet ports and outlet ports in the sleeves and a number of passages through the slide valve, with means for positioning the cylindrical slide valve so that the passages line up with the inlet and exit ports.

The means for applying positive pressure to one end of the slide valve may be a hydraulic fluid system acting on a suitable surface of the slide valve. An electromechanical system could also be used, as described, for example, in UK Patent Applications Nos. 8922883.7 and 9001905.0. The means will move the slide valve from its fail safe position provided the pressure is sufficient to overcome the bias and any annulus fluid pressure on the other side of the valve. As previously stated this means should be an independent system isolated from the annulus fluid and fluid pressures on either side of the valve.

The means to move the valve from its fail safe position by differential annulus fluid pressure will be on the same side of the valve as the independent pressure system and may comprise a second area open to the annulus fluid pressure and a slide shuttle sealing the area but with the slide shuttle capable of contacting the slide valve so that a sufficient annulus fluid pressure in the area will move both the slide shuttle and the slide valve.

The inner and outer sleeves of the valve may themselves provide the barrier to fluid passing along the annulus other than through the valve or the sleeves may be mounted on an annulus packer which provides the barrier. Well bore packers are known per se but the concept of using a packer for supporting a fail safe annulus valve and forming a central hole through the packer for the production bore is believed to be novel and is a significant subsidiary feature of the present invention.

However, as previously indicated, the annulus safety valve of the present invention may be used as an annulus valve for any concentric bore. Thus it could be used as an annulus safety valve for concentric tubing strings. In this and other uses mentioned previously it may not be possible or convenient to use a packer for supporting the annulus safety valve. Instead the safety valve could be part of the innermost tubing string, extending into the annulus to close it and with means for locking the valve into the tubing string forming the outer tube of the annulus. The locking means could be a locking ring or locking dogs co-operating with a groove of the outer tube.

Figure 2:
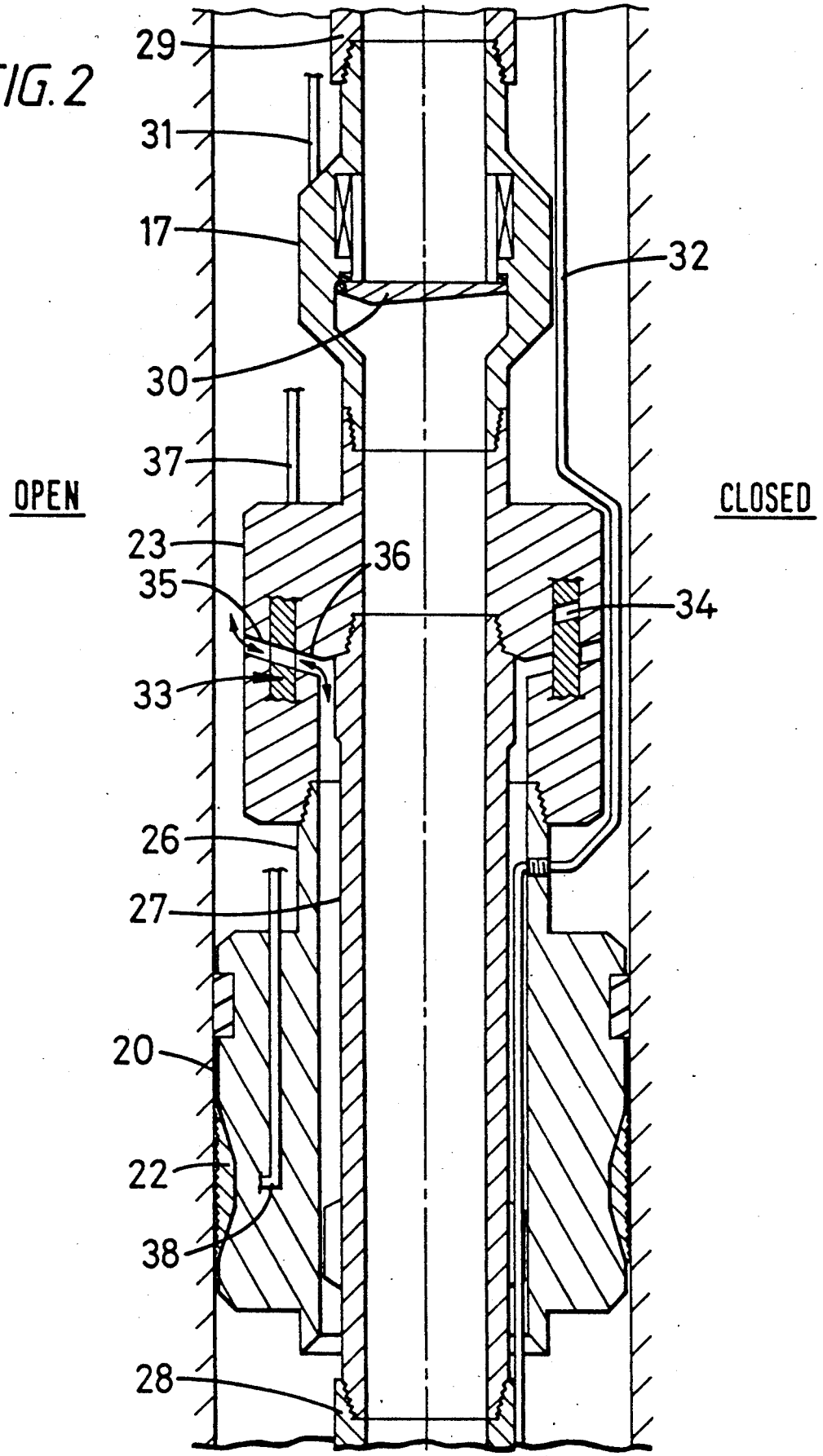
Figure 3:
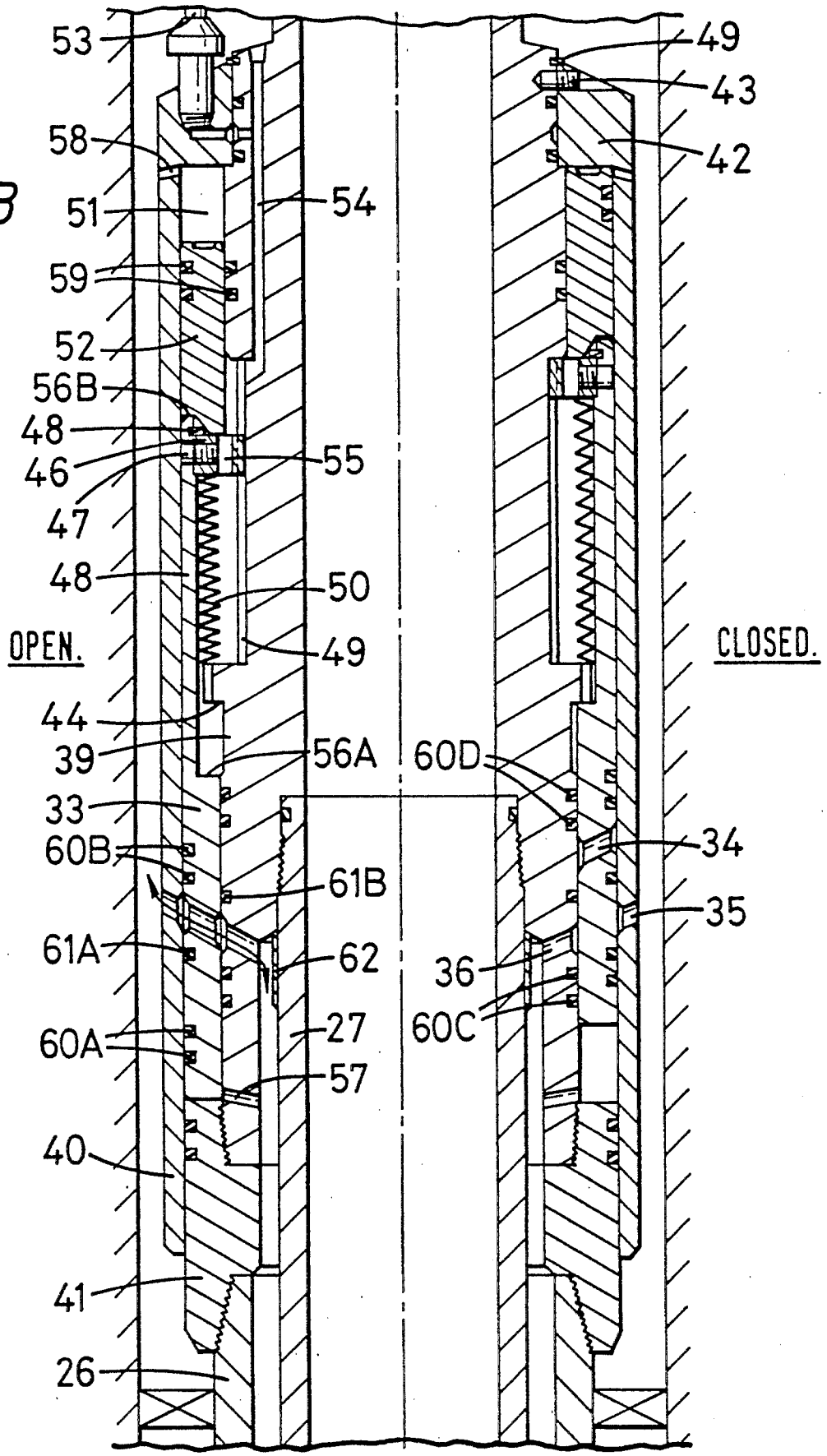
Figure 4A:
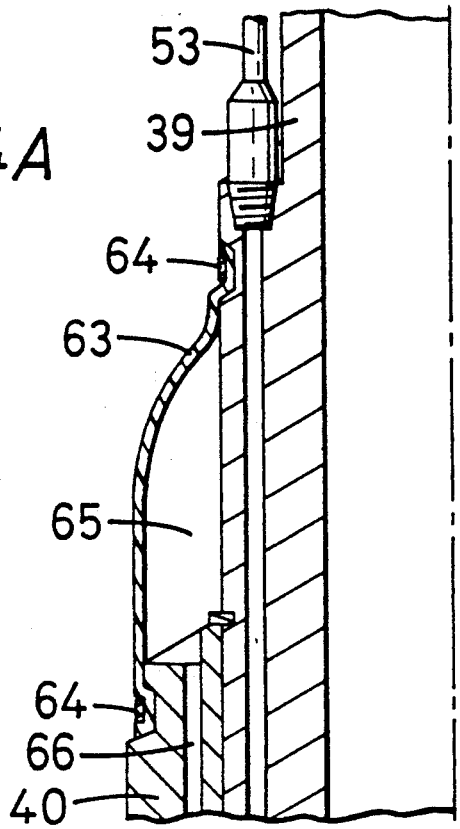
Figure 4B:
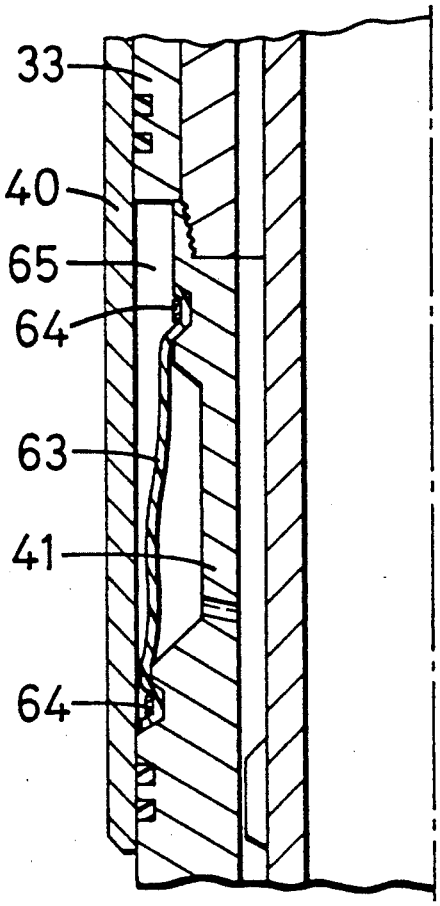
Figure 5:
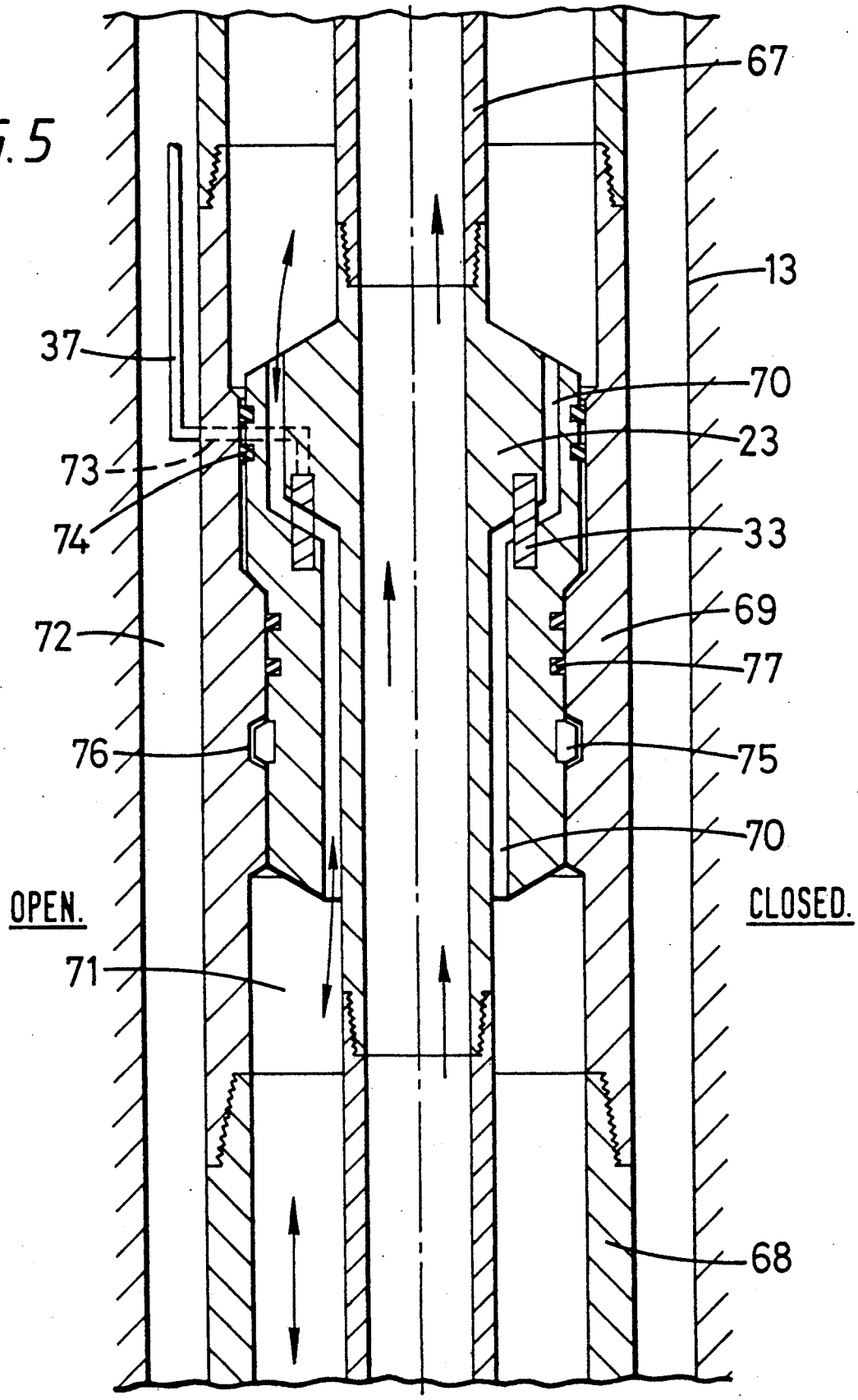

The invention is illustrated with reference to the accompanying drawings in which FIG. 1 is section through a well having a down hole annulus safety valve according to the present invention, FIG. 2 is a more detailed section of the well of FIG. 1 in the vicinity of the downhole annulus safety valve, FIG. 3 is a yet more detailed section of the down hole annulus safety valve itself, FIGS. 4A and 4B show an embodiment of the valve suitable for use with fluids which could damage the valve, and FIG. 5 shows an alternative way of mounting a valve between two tubing strings.

FIG. 1 shows an oil well extending down from a sub-sea well head 5 to a producing formation 6. The sea bed is shown at 7 and the well head has a concentric tubing hanger 8. It will be appreciated that the type of well and well head shown are purely illustrative. The invention can be applied to any well whether sub-sea, on land or on an off-shore platform. The well head itself is also only shown in part and will have all the normal valves, controls and seals to ensure that the well is isolated. Shown in FIG. 1 is a seal 9 for the tubing hanger and passages 10 through the hanger having annulus shut off valves 11. These valves could be of the type described in UK Patent Application 2214543A.

The well has a central completion tubing string 12 and a casing 13 to give a central bore and surrounding annulus. The completion string 12 terminates in a polished bore receptacle 14 mounted on a production packer 15. Tail pipe 16 extends down towards the producing formation. It will be seen from the arrows that this assembly ensures that oil produced from the formation goes up the tail pipe and central bore and not up the annulus. Near the top of the central bore is a conventional production down hole safety valve 17. This could alternatively, be a so-called surface-controlled sub-surface safety valve.

In FIG. 1 gas is being injected into the annulus through passages 10 and valves 11 of the tubing hanger to provide artificial lift for the production oil. Completion string thus has gas lift mandrels 18 and a bottom sidepocket mandrel 19 for circulation, this arrangement again being conventional. Mandrel 19 could be replaced by a wireline operated sleeve, if required.

The annulus has a packer 20 with packer sealing element 21 and slips 22 on which is mounted the annulus down hole safety valve unit 23 of the present invention, shown diagramatically with passages 24 and valves 25. Packer 20 and valve unit 23 seal the annulus so that flow down the annulus can only occur through the valve unit. By using a special control line, pressuring up will pressure set the annulus packer 20.

FIG. 2 is an enlargement of FIG. 1 in the area of valve unit 23 and packer 20. Where appropriate, the same reference numerals are used as in FIG. 1. FIG. 2 shows, particularly, how the valve unit 23 is fixed into the annulus. It is screw threaded onto an upward extension 26 of packer 20 and also onto a tubing joint 27 which acts as part of completion string 12 (FIG. 1). Tubing joint 27 is threaded into a coupling 28 at its lower end which couples it to the completion string 12 below the packer.

Production down hole safety valve 17 is screw threaded into an upward extension of valve unit 23 and also into another completion string coupling 29. The flapper valve of the production down hole safety valve is shown at 30 and a valve hydraulic fluid control line at 31.

A down hole electric gauge line is shown at 32, illustrating how it passes around valve unit 23 and through packer 20 to a down hole gauge (not shown).

FIG. 2 only shows valve unit 23 generally, a detailed drawing and description being given hereafter with reference to FIG. 3. FIG. 2 does show, however, a slide valve 33 in the unit, with its angled passage 34 lining up with angled ports 35, 36 in the valve unit 23 when the valve is open (left hand side of drawing), but not lining up when the valve is closed (right hand side).

As explained more fully in FIG. 3, the valve unit 23 is annular and slide valve 33 is cylindrical so there will be a number of angled passages 34 in the slide valve 33 lining up with a number of ports 35 and 36. FIG. 2, showing the valve open and closed on different sides of the drawing, is thus purely illustrative to show how vertical movement of slide valve 33 acts to open or close the valve.

Hydraulic fluid control line for valve unit 23 is shown at 37, and a hydraulic bore set for packer 20 at 38.

FIG. 2 illustrates the flow of fluid down the annulus, through the valve unit 23 and then down the inside of packer 20. It also illustrates how packer 20, valve unit 23 and production down hole safety valve 17 can be readily assembled as a unit and coupled into the completion string 12. Packer 20 may be pressure set and fixed at an appropriate position in the well, using production bore pressure acting on one-way locking pistons of the hydraulic bore set 38, the pistons acting to expand the packer and drive out slips 22 which seal and lock the packer in place.

The detailed design of valve unit 23 is shown in FIG. 3. It is formed of an inner sleeve 39 screw threaded onto tubing joint 27, and an outer sleeve 40 fixed to valve housing 41 which is screw threaded onto upward extension 26 of packer 20 (FIG. 2). Inner sleeve 39 is also screw threaded into valve housing 41.

Sleeves 39 and 40 thus enclose an area within which slide valve 33 can slide, the area being sealed at the top by the top portion 42 of valve outer sleeve 40. Top portion 42 is fixed to inner sleeve 39 by orientation pins one of which is shown at 43 and is held by circlip 49.

Slide valve 33 is a cylinder with several passages 34 in it positioned so that passages 34 can line up with ports 35 in valve outer sleeve 40 and with ports 36 in inner sleeve 39.

Passages 34, and ports 36 and 35 are all angled at 45° to the longitudinal axis of the valve unit. Slide valve 33 can slide a vertical distance defined by valve housing 41 at the bottom and stop 44 at the top, the valve being open at the bottom of its travel (left hand side of drawing) and closed at the top (right hand side of drawing). Since slide valve 33 is cylindrical, the showing of the valve open and closed on different sides of the drawing is purely illustrative.

Control of the movement of slide valve 33 is effected above the valve proper. Thus slide valve 33 has an upward extension 45. Extension 45 has a stop ring 46 fixed to it by a number of anti-rotation pins 47. Stop ring 46 is held by circlip 48. The inside of stop ring 45 is segmented, the segments fitting into key slots 49 of inner sleeve 39. These segments and slots guide and align the slide valve ensuring that passages 34 always remain aligned with ports 35 and 36. Stop ring 46 also has a number of holes 55 through it.

Spring 50 between stop 44 and stop ring 46 acts to move slide valve 33 to its closed position if not counteracted by other forces.

Inner and outer sleeves 39 and 40 extend upwardly beyond the end of slide valve 33 and its extension 45 to enclose a further area 51, within which is a further slide shuttle 52. The bottom of slide shuttle 52 can contact the upward extension 45 and stop ring 46 of slide valve 33.

In the top portion 42 of outer sleeve 40 is inlet 53 for hydraulic control fluid. The control fluid can pass from the inlet through passage 54 in inner sleeve 39 and through holes 55 in stop ring 46 to apply pressure to the top surfaces 56A and 56B of slide valve 33. The bottom of slide valve 33 is accessible to fluid pressure in the annulus below the valve unit because of port 57 in inner sleeve 39, so that the forces tending to move the slide valve 33 to its upper closed position are spring 50 and annulus fluid pressure (if any) below the valve unit.

The forces tending to move the slide valve 33 to its bottom open position are hydraulic control fluid pressure applied through inlet 53 and bearing on slide valve tops 56A and 56B and annulus fluid pressure above the valve unit, annulus fluid being free to pass through port 58 at the top of outer sleeve 40 into area 51 and hence to apply pressure to the top of slide shuttle 52. Although there are two fluids (annulus fluid and control fluid) capable of applying downward pressure on the slide valve, the use of slide shuttle 52 means that the two fluids cannot intermingle and are kept quite separate, double moving seals 59 on slide shuttle 52 and inner sleeve 39 ensuring that there is no leakage of upper annulus fluid into the control fluid.

Sealing to ensure that there is no leakage of fluid between sliding surfaces is, of course, important and shown throughout FIG. 3 are various seals indicated by solid shading. Not all of the seals are identified by numerals, but of particular importance, in addition to the double seals 59 for slide shuttle 52, are the double moving seals 60 and the single seal 61 on slide valve 33 sealing the slide valve and the ports and passages 34, 35, 36, and corresponding seals on inner sleeve 39.

Double seals 59, 60 and other double seals have one explosive decompression resistant seal and one chemically resistant seal, so that there is, in effect, double sealing between important pressure areas. The seals protecting the ports and passage are located internally and externally of slide valve 33 giving two independent sealing systems. Thus there are double seals 60A and 60B and single seal 61A on slide valve 33 and also double seals 60C and 60D and single seal 61B on inner sleeve 39 so that slide valve 33 is fully sealed on both sides.

The ports and passage are fully aligned when the valve is open and the seals are positioned so that no fluid should in fact contact the seal faces when the valve is either open or closed.

Finally, FIG. 3 shows that, to minimise erosion, where the annulus fluid changes direction to pass through ports 35, 36 and passages 34, the ports and passage are chamfered and there is a hard surface insert 62 on the tubing joint 27 adjacent to port 36.

FIG. 3 shows that the annulus safety valve of the present invention is designed to close and isolate the well head from pressure in the annulus below the valve bearing on the bottom of slide valve 33. Spring 50 also closes the valve in pressure-less circumstances. However, the closure can be over ridden by hydraulic fluid control line pressure on the tops 56A and 56B of slide valve 33. This will be the normal method of valve operation and control, with the control fluid pressure being greater than the upper annulus fluid pressure bearing on the top of slide shuttle 52. Provided the control fluid pressure is the greater, then slide shuttle 52 stays at the top of area 51 and does not move down to contact the slide valve extension 45 and stop ring 46.

However, if there is a failure or diminution of the control fluid pressure, then the valve unit can be operated by the balance between the upper annulus fluid pressure on the one hand and the lower annulus fluid pressure and the force of spring 50 on the other hand. A low upper annulus pressure will mean that the valve closes, isolating the upper annulus and well head from high lower annulus downhole pressure.

If a high upper annulus pressure develops it can, however, open the valve and vent into the lower annulus ensuring that an upper annulus high pressure build-up does not occur between the valve and the well head. (Failure to vent high pressure upper annulus fluid could cause the production tubing to collapse).

An ability to open the valve using upper annulus fluid pressure (even if the control system is damaged) allows safe intervention to make a well permanently safe. Thus well kill facilities, heavy mud circulation or the injection of cement plugs will still be possible even with a damaged valve control system.

The various forces acting on slide valve 33 can be varied by varying the surface areas exposed to the various pressures. In FIG. 3 the area of slide valve 33 exposed to the upper annulus pressure is greater than the area exposed to the lower annulus pressure. This allows the valve to be easily opened when injecting and, once open, to remain open without fluttering. However, in other circumstances a different bias may be desirable.

FIG. 3 also shows that the flow areas of the ports 35, 36 and passages 34 exceed the flow area immediately below tubing string 27 and inner sleeve 39. This ensures that the pressure drop through the valve does not occur across the ports and passage themselves (i.e. it prevents them from acting as a choke). This minimises erosion in this important area. The fact that the flow constriction is in the lower annulus below the valve proper ensures that excessive upward annulus flow causes a bias pressure which assists in closing the valve. However if there is a loss of control fluid pressure then the full lower annulus pressure is applied to the bottom of slide valve 33 assisting springs 50 to close the valve.

The above discussion on flow areas and constrictions shows how these can be designed to assist valve operation. Obviously however, they must be designed to exceed the required operational flow rates so as not to cause an overall pressure drop through the system.

FIGS. 1 to 3 show how a valve of the present invention can be used as an annulus down hole safety valve for use in a well using gas lift injection to stimulate oil flow. It can also be used in any other situation where an annulus safety valve may be required, and FIG. 5 shows an alternative situation.

The valve as described is a fail safe closed valve. It will be appreciated, however, that by a suitable change in the positions of ports 35, 36 and passages 34, the valve could readily be adapted to fail safe open.

From FIG. 3 it will be seen that the ends at least of the slide valve 33 are exposed to the fluid in the annulus.

If this fluid were corrosive, contained sand or were otherwise non-friendly it could affect the adjacent seal faces. In such a situation the slide valve ends and seal faces could be protected by flexible diaphragms enclosing an intermediate non-corrosive fluid which would be the only fluid in contact with the slide valve ends.

FIGS. 4A and 4B show how such diaphragms could be fitted. Thus FIG. 4A shows a diaphragm 63 fixed by spring ring 64 between outer sleeve 40 and inner sleeve 39 and enclosing a non-corrosive fluid 65 which can, via passage 66, enter area 51 and exert pressure on slide shuttle 52, when the upper annulus fluid contacts and exerts pressure on the outside of diaphragm 63. The diaphragm may be formed of a suitable elastomeric material or metal bellows which are unaffected by the annulus fluid.

FIG. 4B shows a suitable arrangement for the bottom end of slide valve 33, with diaphragm 63 fixed by rings 64 between two grooves in inner sleeve 39. Intermediate fluid 65 is the only fluid in direct contact with the end of slide valve 33.

FIGS. 1 to 3 show the use of an annulus safety valve located on a packer and suitable, for example, for an annulus using artificial lift. However there could be two completion tubing strings giving two annuli and a central bore, and either or both of the annuli could be sealed by an annulus safety valve of the present invention. If only the outermost annulus requires sealing, then it will only be necessary to place a further flow tube inside the completion string. If, however, the inner of the two annuli needs to be sealed as an alternative or in addition to the outer annulus, then FIG. 5 shows how an annulus safety valve could be inserted in an inner annulus.

FIG. 5 shows an inner tubing string 67, outer tubing string 68, and well casing 13. Valve unit 23 is an insert of inner tubing string 67 screw threaded into lengths of inner tubing above and below it. Outer tubing string 68 also has a tubing insert 69 screw threaded into it.

Valve unit 23 has passages 70 in it allowing fluid flow up or down the inner annulus 71 through a slide valve 33. The valve itself is identical with the valve of FIGS. 1 to 3 and need not be described again. Control line 37 for hydraulic fluid to the valve is shown coming down outer annulus 72 and passing through a passage 73, with seals 74, in outer tubing insert 69 to the valve. However, control line 37 could, if required, come down the inner annulus 71.

The new feature of FIG. 5 is the method of locating valve unit 23 in the inner annulus using locking dogs 75 on the valve unit cooperating with a groove 76 of outer tubing insert 69. Seals 77 are shown to prevent leakage between the valve unit and the outer tubing insert and there may be additional seals as required.

The valve unit of FIG. 5 could be pre-assembled in a completion below either a dual bore or concentric tubing hanger, or the valve unit could be lowered with the inner tubing string 67 and locked into place when it reaches the outer tubing insert 69. Locking could be effected in any convenient manner, e.g. mechanically with springs or hydraulically. Various forms of locking mechansim and locking controls are generally known and any convenient form may be used.

The arrangement shown in FIG. 5 may be used in any situation where it may not be convenient to mount the valve unit on an annulus packer.

I claim:

1. A fail safe annulus valve for fluids comprising:

(a) an inner and an outer sleeve across an annulus enclosing a valve area, (b) an inlet port into the area in one sleeve and an outlet port in the other, (c) a slide valve in an area capable of sliding to open or close the ports but biased to remain in a fail safe position if no pressure is applied to it, (d) means for applying positive pressure to one end of the valve to move the valve from its fail safe position, said means being independent of the annulus fluid pressures on either side of the valve, and (e) means to move the valve from its fail safe position if there is a predetermined differential annulus fluid pressure across the valve.

2. A fail safe annulus valve as claimed in claim 1 which fails safe closed.

3. A fail safe annulus valve as claimed in claim 1 wherein the bias to maintain the slide valve in a fail safe position is a spring.

4. A fail safe annulus valve as claimed in claim 1 wherein the slide valve has a passage through it capable of being aligned with the inlet and exit ports.

5. A fail safe annulus valve as claimed in claim 4 wherein the valve area is annular, the slide valve is cylindrical and there are a number of inlet and exit ports and passages for fluid flow.

6. A fail safe annulus valve as claimed in claim 4 wherein the inlet and exit ports and passage are angled with respect to the fluid flow along the annulus.

7. A fail safe annulus valve as claimed in claim 1 wherein the means for applying positive pressure to one end of the valve is a hydraulic fluid system acting on a surface of the slide valve.

8. A fail safe annulus valve as claimed in claim 1 wherein the means to move the valve by differential annulus fluid pressure across the valve is a second area open to annulus fluid pressure on the same side as the independent pressure system but sealed from the independent pressure system and a slide shuttle in the second area capable of contacting the slide valve.

9. A fail safe annulus valve as claimed in claim 1 wherein the valve is mounted on an annulus packer having a central hole.

10. A fail safe annulus valve as claimed in claim 1 wherein the valve is fixed to tubing of the annulus and is locked into the annulus by locking means between the valve and the other tubing of the annulus.

11. A fail safe annulus valve as claimed in claim 1 wherein the slide valve is sealed from contact with annulus fluid by flexible diaphragms enclosing non-corrosive fluid between the diaphragms and the slide valve.

* * * * *